US011383911B2

(12) United States Patent
Chia et al.

(10) Patent No.: US 11,383,911 B2
(45) Date of Patent: Jul. 12, 2022

(54) LIQUID CONTAINING ASSEMBLY

(71) Applicant: Wei-Sheng Chia, Zhubei (TW)

(72) Inventors: Wei-Sheng Chia, Zhubei (TW); I-Chen Chia, Zhubei (TW); Su-Jung Feng, Zhubei (TW); Chih-Sen Chia, Zhubei (TW)

(73) Assignee: Wei-Sheng Chia, Zhubei (TW)

( * ) Notice: Subject to any disclaimer, the term of this patent is extended or adjusted under 35 U.S.C. 154(b) by 256 days.

(21) Appl. No.: 16/835,347

(22) Filed: Mar. 31, 2020

(65) Prior Publication Data

US 2020/0377282 A1 Dec. 3, 2020

(30) Foreign Application Priority Data

May 31, 2019 (TW) ..... 108118857

(51) Int. Cl.
*B65D 81/36* (2006.01)
*B65D 61/02* (2006.01)

(52) U.S. Cl.
CPC ..... *B65D 81/361* (2013.01); *B65D 61/02* (2013.01); *B65D 2209/00* (2013.01); *B65D 2231/00* (2013.01); *B65D 2303/00* (2013.01)

(58) Field of Classification Search
CPC ..... B65D 81/361; B65D 61/02; B65D 81/36; B65D 61/00; B65D 2303/00
USPC ..... 206/216, 217, 218, 303, 445; 215/395
See application file for complete search history.

(56) References Cited

U.S. PATENT DOCUMENTS 5,823,391 A * 10/1998 Klauke ..... B65D 35/22 220/4.27
6,382,411 B1 * 5/2002 Wentling ..... A47J 41/0083 206/217
6,506,092 B1 * 1/2003 Kuracina ..... G10K 11/08 220/759

* cited by examiner

*Primary Examiner* — Rafael A Ortiz

(57) ABSTRACT

A liquid containing assembly includes a clamping device, a supplementary package and a positioning mechanism. The clamping device includes a first and second surrounding bodies rotatably connected to each other. A clamping space is formed when the first and second surrounding bodies are closed to each other. The supplementary package includes an accommodating body to accommodate liquid and an open tube connected to the accommodating body. The positioning mechanism includes a first positioning portion on a portion of the accommodating body adjacent to the open tube, a second positioning portion corresponding to the first positioning portion and is at least on one of the first and second surrounding bodies, a third positioning portion on the accommodating body, and a fourth positioning portion corresponding to the third positioning portion and at least on one of the first and second surrounding bodies.

10 Claims, 5 Drawing Sheets

LIQUID CONTAINING ASSEMBLY

FIELD OF THE INVENTION

The present invention relates to a liquid containing assembly, and more particularly to a liquid containing assembly applied to a supplementary package.

BACKGROUND OF THE INVENTION

Plastic containers such as PET bottles for containing drinking including water, Coke or juice, or plastic bottles for containing daily-life liquid such as shampoo, shower gel or laundry detergent, have been widely used by modern people for daily life. However, most of these PET bottles or plastic bottles are discarded only used one time, which causes great damage to the environment.

Some suppliers of daily necessities introduce supplemental packages. The suppliers hope that consumers may purchase the supplemental packages and pour the liquid in the supplemental packages into an empty plastic container to make full use of the plastic container.

However, the motivation for a customer buying supplemental packages is that he or she has empty plastic containers at home, which is not a strong purchasing motivation for an ordinary customer. Furthermore, the purchasing motivation of customers may be further lowered when they pour the liquid in a supplemental package into an empty plastic container and discover that some liquid is inevitably remained in the supplemental package, thereby failing to make full use of the liquid.

Thus, the current supplemental packages have limited effect for reducing plastic containers, but it is an urgent task to effectively reduce the damage of plastic containers to the global environment.

SUMMARY OF THE INVENTION

The present invention provides a liquid containing assembly, which is used to replace current plastic containers and has features including easy operation, high durability and good stability.

The present invention provides a liquid containing assembly, which includes a clamping device, a supplementary package and a positioning mechanism. The clamping device includes a first surrounding body and a second surrounding body rotatably connected to the first surrounding body. A clamping space is formed when the first surrounding body is closed to the second surrounding body. The supplementary package includes an accommodating body configured to accommodate liquid and an open tube connected to the accommodating body. The positioning mechanism includes a first positioning portion, a second positioning portion, at least one third positioning portion and at least one fourth positioning portion. The first positioning portion is disposed on a portion of the accommodating body of the supplementary package adjacent to the open tube. The second positioning portion corresponds to the first positioning portion and is disposed at least on one of the first surrounding body and the second surrounding body. The at least one third positioning portion is disposed on the accommodating body of the supplementary package. The at least one third positioning portion is away from the open tube relative to the first positioning portion. The at least one fourth positioning portion corresponds to the at least one third positioning portion and is disposed at least on one of the first surrounding body and the second surrounding body.

In an embodiment of the present invention, the first positioning portion is annular to surround the accommodating body. The second positioning portion includes two plates disposed spaced apart from each other. The first positioning portion is positioned between the two plates.

In an embodiment of the present invention, a surface of the first positioning portion has a jagged structure. The second positioning portion further includes a jagged plate disposed between the two plates and corresponding to the jagged structure of the first positioning portion.

In an embodiment of the present invention, the at least one third positioning portion is sheet-shaped and connected to a bottom of the accommodating body. The at least one fourth positioning portion includes a first block and a second block. A gap corresponding to the at least one third positioning portion is formed between the first block and the second block.

In an embodiment of the present invention, both of the first block and the second block of the at least one fourth positioning portion have an inclined surface.

In an embodiment of the present invention, the positioning mechanism includes two third positioning portions disposed opposite to each other and two fourth positioning portions respectively disposed on the first surrounding body and the second surrounding body. The positioning mechanism further includes two reinforcing ribs. Two ends of each of the reinforcing ribs are respectively connected to the two third positioning portions, and the two reinforcing ribs cross each other.

In an embodiment of the present invention, the first surrounding body has a first top edge. The second surrounding body has a second top edge. The first top edge is jointed to the second top edge to form an opening to expose the open tube of the supplementary package when the first surrounding body is closed to the second surrounding body.

In an embodiment of the present invention, the first surrounding body includes a first side wall and a first bottom wall connected to the first side wall. The second surrounding body includes a second side wall and a second bottom wall connected to the second side wall. Rotation of the first surrounding body relative to the second surrounding body closes the first side wall to the second side wall and closes the first bottom wall to the second bottom wall.

In an embodiment of the present invention, the first side wall includes a first fastening portion. The second side wall includes a second fastening portion corresponding to the first fastening portion.

In an embodiment of the present invention, the first fastening portion is a convex portion, and the second fastening portion is an opening.

The operation of the liquid containing assembly of the embodiments of the present invention is quite convenient. A user may directly place the supplementary package into the open clamping device, move the supplementary package to a right position by the guidance of the positioning mechanism, and then simply close the clamping device. As such, the user can directly use the liquid in the supplementary package without having to pour it into another container to fully use the liquid in the supplementary package. In addition, since the upper and lower portions of the supplementary package are supported by the positioning mechanism, the weight of the supplementary package can be dispersed throughout the entire clamping device, thereby preventing the clamping device from being easily damaged due to long-term uneven force. In addition, since being supported by the clamping device, the supplementary package may maintain its shape to allow the entered air to replace the lost liquid even when a part of the liquid is poured from the supplementary package, thereby preventing the supplementary package from being compressed and difficult of access the remaining liquid. In addition, the positioning mechanism allows the supplementary package to be stably clamped in the clamping device, so that the user can carry it with him or her.

Form above, it can be seen that, the liquid containing assembly of the embodiment of the present invention can replace most of the current plastic containers used for liquid. As such, the output of plastic products can be greatly reduced and thereby greatly contributing to the environment of the earth.

Other objectives, features and advantages of the invention will be further understood from the further technological features disclosed by the embodiments of the invention.

BRIEF DESCRIPTION OF THE DRAWINGS

The present invention will become more readily apparent to those ordinarily skilled in the art after reviewing the following detailed description and accompanying drawings, in which.

DETAILED DESCRIPTION OF PREFERRED EMBODIMENTS

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1A:
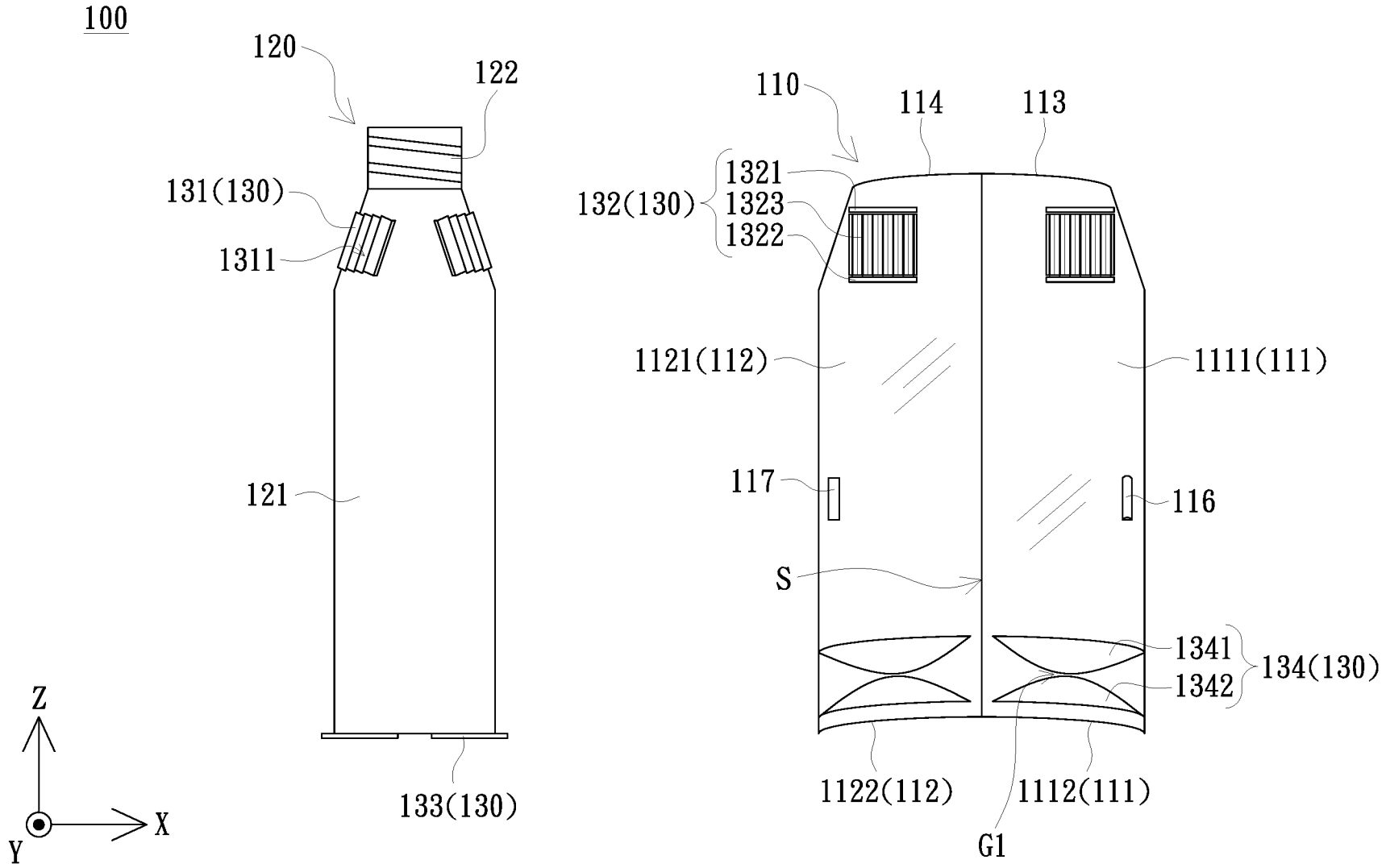
FIG. 1A is a schematic exploded view of a liquid containing assembly of an embodiment of the present invention.
Figure 1B:
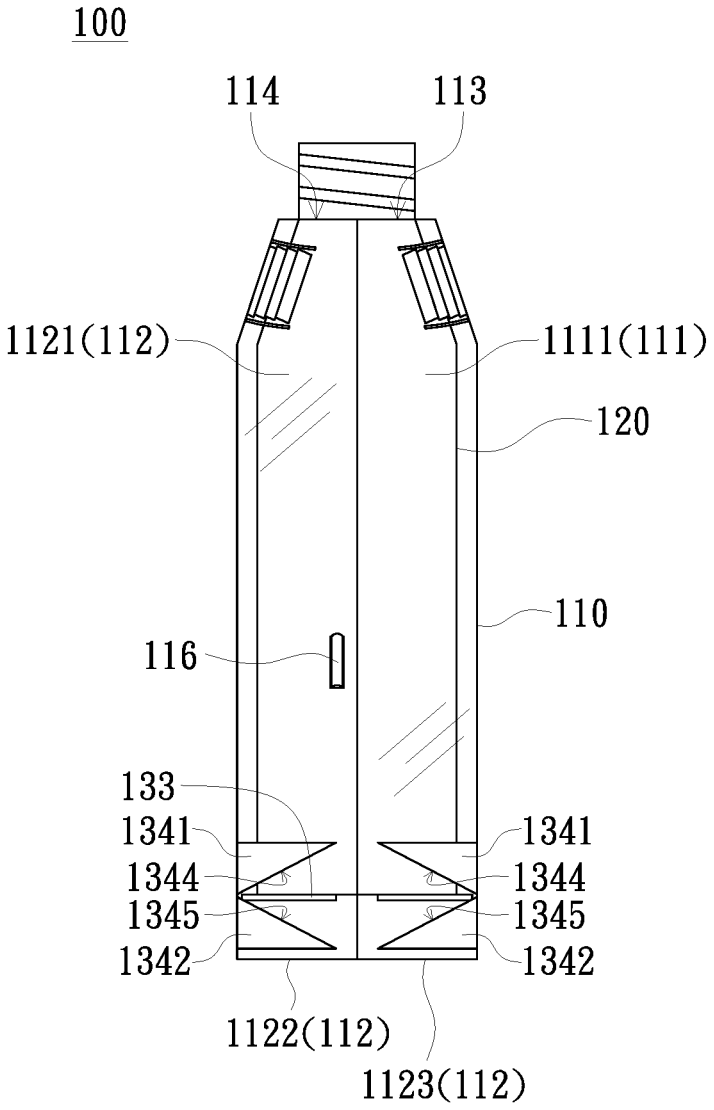
FIG. 1B is a schematic assembly view of a liquid containing assembly of an embodiment of the present invention.
Figure 1C:
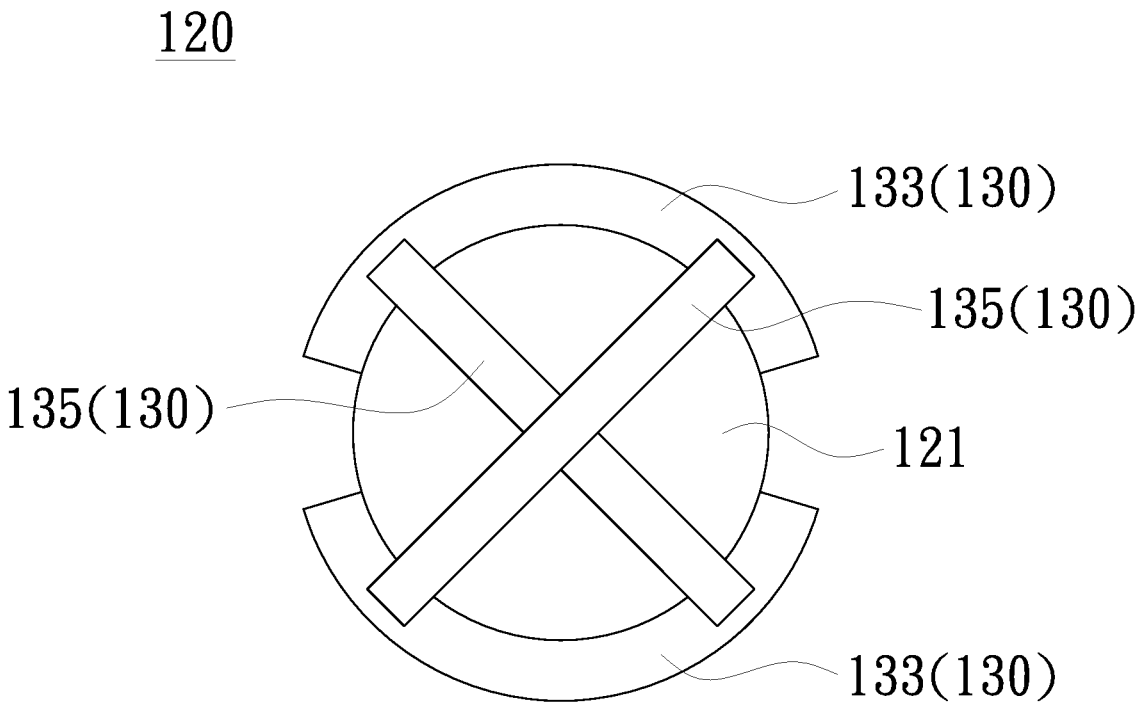
FIG. 1C is a schematic view of a bottom of a supplementary package of an embodiment of the present invention.
Figure 1D:
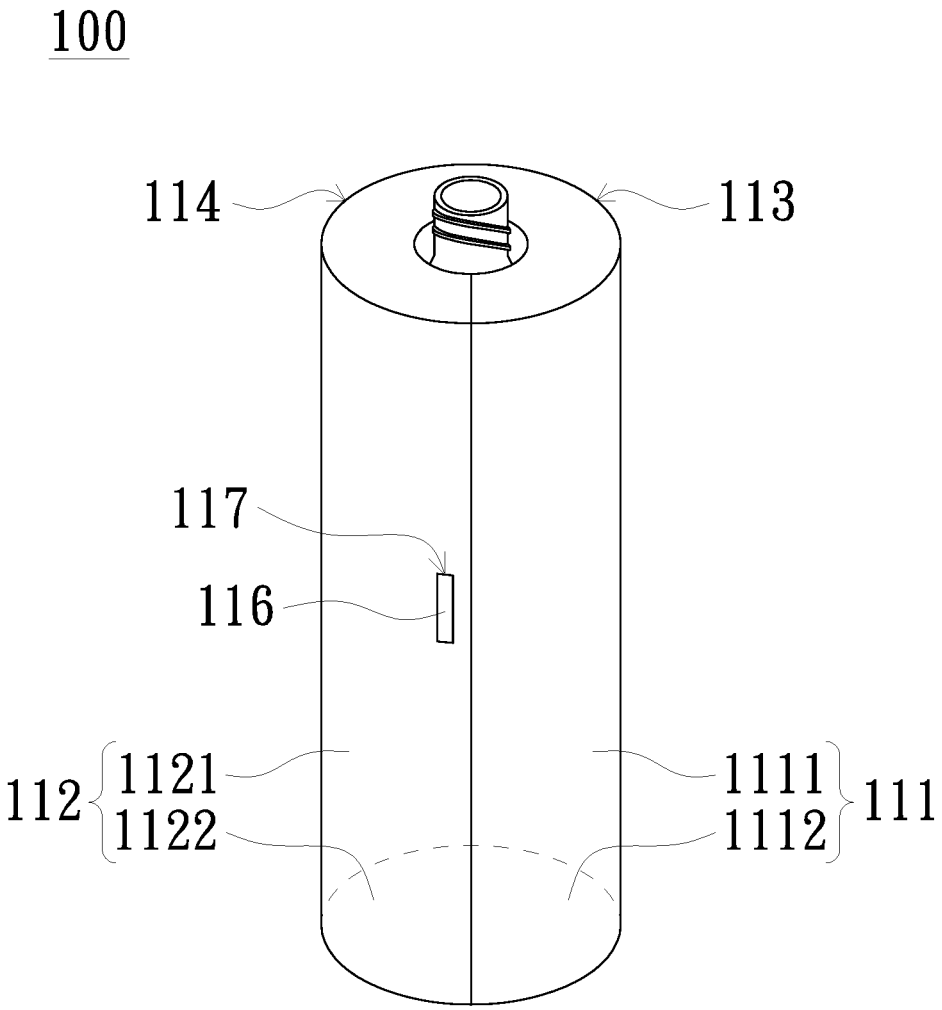
FIG. 1D is a schematic perspective view of a liquid containing assembly of an embodiment of the present invention.
Figure 1E:
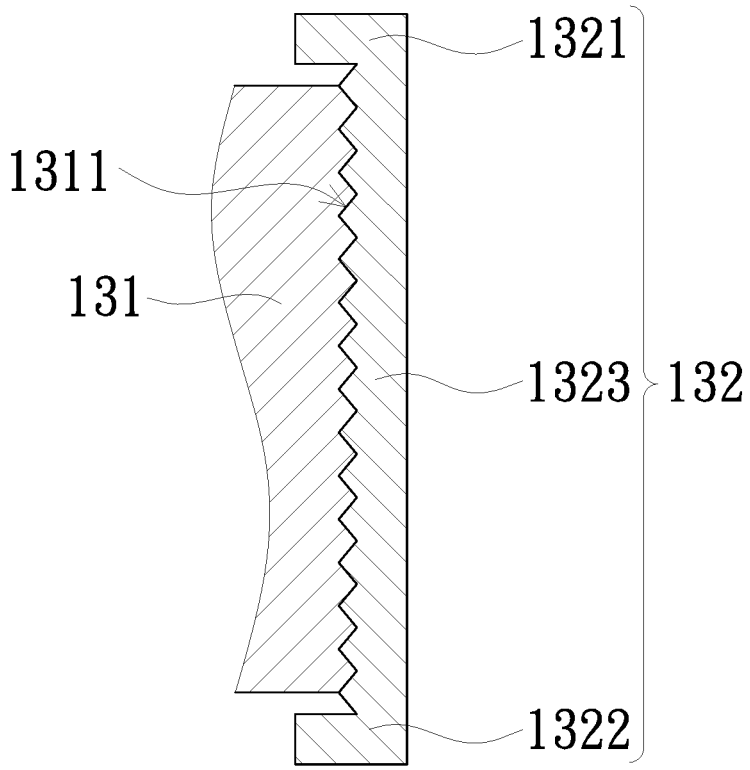
FIG. 1E is a schematic cross-sectional view of a first positioning portion positioned at a second positioning portion of an embodiment of the present invention.

FIG. 1A is a schematic exploded view of a liquid containing assembly of an embodiment of the present invention. FIG. 1B is a schematic assembly view of a liquid containing assembly of an embodiment of the present invention. FIG. 1C is a schematic view of a bottom of a supplementary package of an embodiment of the present invention. FIG. 1D is a schematic perspective view of a liquid containing assembly of an embodiment of the present invention. FIG. 1E is a schematic cross-sectional view of a first positioning portion positioned at a second positioning portion of an embodiment of the present invention. Please refer to FIGS. 1A to 1E, a liquid containing assembly 100 of the embodiment includes a clamping device 110, a supplementary package 120 and a positioning mechanism 130. The supplementary package 120 includes an accommodating body 121 configured to accommodate liquid and an open tube 122 connected to the accommodating body 121. The open tube 122 may have tread for connecting a cap (not shown) or a pressure head (not shown).

The clamping device 110 includes a first surrounding body 111 and a second surrounding body 112 rotatably connected to the first surrounding body 111. The first surrounding body 111 can be closed to the second surrounding body 112 to form a clamping space S to accommodate the supplementary package 120. The first surrounding body 111 has a first top edge 113, and the second surrounding body 112 has a second top edge 114. The first top edge 113 is jointed to the second top edge 114 to form an opening to expose the open tube 122 of the supplementary package 120 when the first surrounding body 111 is closed to the second surrounding body 112.

The positioning mechanism 130 may include a first positioning portion 131, at least one second positioning portion 132, at least one third positioning portion 133 and at least one fourth positioning portion 134. Specifically, the first positioning portion 131 is disposed on a portion of the accommodating body 121 of the supplementary package 120 adjacent to the open tube 122. The second positioning portion 132 is corresponding to the first positioning portion 131 and disposed at least on one of the first surrounding body 111 and the second surrounding body 112. The third positioning portion 133 is disposed on the accommodating body 121 of the supplementary package 120 and away from the open tube 122 relative to the first positioning portion 131. The fourth positioning portion 134 is corresponding to the third positioning portion 133 and disposed at least on one of the first surrounding body 111 and the second surrounding body 112. In the present embodiment, both of the first surrounding body 111 and the second surrounding body 112 have the second positioning portion 132 and the fourth positioning portion 134, but the invention is not limited thereto.

In the present embodiment, the first positioning portion 131 is annular to surround the accommodating body 121. The second positioning portion 132 includes a plate 1321 and a plate 1322 spaced apart from the plate 1321. The first positioning portion 131 can be positioned between the plate 1321 and plate 1322. The first positioning portion 131 is illustrated as two sections in FIG. 1A for corresponding to the second positioning portions 132 respectively on the first surrounding body 111 and the second surrounding body 132, but the invention is not limited thereto. The first positioning portion 131 can be also a full ring or a partial ring. A surface of the first positioning portion 131 has a jagged structure 1311, and the second positioning portion 132 further includes a jagged plate 1323 disposed between the plate 1321 and the plate 1322. The jagged plate 1323 corresponds to the jagged structure 1311 of the first positioning portion 131. The first positioning portion 131 can be positioned to the second positioning portion 132 when the supplementary package 120 is placed on the first surrounding body 111 or the second surrounding body 112, so that the supplementary package 120 can be positioned to the clamping device 110 in the Z-axis direction in FIG. 1A. The jagged structure 1311 of the first positioning portion 131 can be meshed with the jagged plate 1323 of the second positioning portion 132, thereby inhibiting the supplementary package 120 to rotate relative to the clamping device 110, but the invention is not limited thereto. In other non-illustrative embodiments, the rotation positioning between the first positioning portion 131 and the second positioning portion 132 can be also achieved by non-skid surfaces.

In the present embodiment, the third positioning portion 133 is sheet-shaped and is connected to the bottom of the accommodating body 121. The fourth positioning portion 134 includes a first block 1341 and a second block 1342. A gap G1 corresponding to the third positioning portion 133 is formed between the first block 1341 and the second block 1342. The first block 141 and the second block 1342 of the fourth positioning portion 134 respectively have an inclined surface 1344 and an inclined surface 1345, so that the third positioning portion 133 can slide into the gap G1 along the inclined surfaces 1344, 1345. In the positioning mechanism 130, both of the first surrounding body 111 and the second surrounding body 112 are provided with the fourth positioning portion 134, and correspondingly there are two third positioning portions 133 opposite to each other on the bottom of the accommodating body 121. As shown in FIG. 1C, the positioning mechanism 130 can further include two reinforcing ribs 135. Each of the reinforcing ribs 135 has two ends respectively connected to the two third positioning portions 133, and the two reinforcing ribs 135 cross each other on the bottom of the accommodating body 121. The positioning of the supplementary package 120 relative to the clamping device 110 in the Z-axis direction can be further enhanced by the positioning between the third positioning portion 133 and the fourth positioning portion 134.

In the present embodiment, the first surrounding body 111 can include a first fastening portion 116, and the second surrounding body 112 can include a second fastening portion 117 corresponding to the first fastening portion 116. As shown in FIG. 1A, the first fastening portion 116 can be a convex portion, and the second fastening portion 117 can be an opening. The first surrounding body 111 and the second surrounding body 112 closed to each other can be also fixed to each other when the first fastening portion 116 is embedded into the second fastening portion 117, but the invention is not limited thereto. In other non-illustrative embodiments, the fastening between the first fastening portion 116 and the second fastening portion 117 can be replaced by other connecting means such as the connection of Velcro tape or a connection of a sliding block with a sliding slot. Even in other embodiments, an elastic member can be disposed at a rotational connection between the first surrounding body 111 and the second surrounding body 112. As such, the first surrounding body 111 can be automatically opened from or closed to the second surrounding body 112 when the first surrounding body 111 and the second surrounding body 112 are relatively rotated to a fixed angle. The supplementary package 120 and the clamping device 110 are also positioned in various directions of the plane perpendicular to the Z-axis direction in FIG. 1A (the horizontal direction when the liquid containing assembly 100 is upright) when the first surrounding body 111 is closed to the second surrounding body 112.

In the present embodiment, the first surrounding body 111 includes a first side wall 1111 and a first bottom wall 1112 connected to the first side wall 1111. The second surrounding body 112 includes a second side wall 1121 and a second bottom wall 1122 connected to the second side wall 1121. The rotation of the first surrounding body 111 relative to the second surrounding body 112 closes the first side wall 1111 to the second side wall 1122 and closes the first bottom wall 1112 to the second bottom wall 1122, so as to form the clamping space S. A plate can be formed after the first bottom wall 1112 is closed to the second bottom wall 1122, so that the liquid containing assembly 100 can be upright.

If the liquid containing assembly 100 of the present embodiment completely replaces the current plastic containers, a user may only need to prepare a plurality of different sized clamping devices 110, and the supplier can turn to manufacture products, such as daily necessities including shampoo, shower gel or laundry detergent, or drinking including tea, soda or mineral water, in the form of the supplementary package 120. Plastic waste can be largely reduced due to the volume of the supplementary package 120 is much smaller than that of a plastic container having the same capacity. In addition, compared with the conventional plastic containers, the supplementary package 120 is more suitable for being made of a decomposable green material, thereby further reducing the impact on the environment.

The operation of the liquid containing assembly of the embodiments of the present invention is quite convenient. A user may directly place the supplementary package into the open clamping device, move the supplementary package to a right position by the guidance of the positioning mechanism, and then simply close the clamping device. As such, the user can directly use the liquid in the supplementary package without having to pour it into another container to fully use the liquid in the supplementary package. In addition, since the upper and lower portions of the supplementary package are supported by the positioning mechanism, the weight of the supplementary package can be dispersed throughout the entire clamping device, thereby preventing the clamping device from being easily damaged due to long-term uneven force. In addition, since being supported by the clamping device, the supplementary package may maintain its shape to allow the entered air to replace the lost liquid even when a part of the liquid is poured from the supplementary package, thereby preventing the supplementary package from being compressed and difficult of access the remaining liquid. In addition, the positioning mechanism allows the supplementary package to be stably clamped in the clamping device, so that the user can carry it with him or her.

Form above, it can be seen that, the liquid containing assembly of the embodiment of the present invention can replace most of the current plastic containers used for liquid. As such, the output of plastic products can be greatly reduced and thereby greatly contributing to the environment of the earth.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A liquid containing assembly, comprising:

a clamping device, comprising a first surrounding body and a second surrounding body rotatably connected to the first surrounding body, wherein a clamping space is formed when the first surrounding body is closed to the second surrounding body;

a supplementary package, comprising an accommodating body configured to accommodate liquid and an open tube connected to the accommodating body; and a positioning mechanism, comprising:

a first positioning portion, disposed on a portion of the accommodating body of the supplementary package adjacent to the open tube, and at least partially surrounds the accommodating body;

a second positioning portion, corresponding to the first positioning portion and disposed at least on one of the first surrounding body and the second surrounding body;

a third positioning portion, disposed on the accommodating body of the supplementary package, wherein the third positioning portion is away from the open tube relative to the first positioning portion; and a fourth positioning portion, corresponding to the third positioning portion and disposed at least on one of the first surrounding body and the second surrounding body;

wherein one of the second positioning portion and the fourth positioning portion achieves the rotation positioning of the supplementary package in the clamping device, and the other achieves the longitudinal positioning of the supplementary package in the clamping device.

2. The liquid containing assembly according to claim 1, wherein the first positioning portion and the second positioning portion achieve the rotation positioning of the supplementary package in the clamping device, and the third positioning portion and the fourth positioning portion achieve the longitudinal positioning of the supplementary package in the clamping device; the first positioning portion is annular to surround the accommodating body, the second positioning portion comprises two plates disposed spaced apart from each other, and the first positioning portion is positioned between the two plates.

3. The liquid containing assembly according to claim 2, wherein a surface of the first positioning portion has a jagged structure, and the second positioning portion further comprises a jagged plate disposed between the two plates and corresponding to the jagged structure of the first positioning portion.

4. The liquid containing assembly according to claim 1, wherein the third positioning portion is sheet-shaped and connected to a bottom of the accommodating body, the fourth positioning portion comprises a first block and a second block, and a gap corresponding to the one third positioning portion is formed between the first block and the second block.

5. The liquid containing assembly according to claim 4, wherein both of the first block and the second block of the fourth positioning portion have an inclined surface.

6. The liquid containing assembly according to claim 4, wherein the positioning mechanism comprises two third positioning portions disposed opposite to each other and two fourth positioning portions respectively disposed on the first surrounding body and the second surrounding body, the positioning mechanism further comprises two reinforcing ribs, two ends of each of the reinforcing ribs are respectively connected to the two third positioning portions, and the two reinforcing ribs cross each other.

7. The liquid containing assembly according to claim 1, wherein the first surrounding body has a first top edge, the second surrounding body has a second top edge, and the first top edge is jointed to the second top edge to form an opening to expose the open tube of the supplementary package when the first surrounding body is closed to the second surrounding body.

8. The liquid containing assembly according to claim 1, wherein the first surrounding body comprises a first side wall and a first bottom wall connected to the first side wall, the second surrounding body comprises a second side wall and a second bottom wall connected to the second side wall, and rotation of the first surrounding body relative to the second surrounding body closes the first side wall to the second side wall and closes the first bottom wall to the second bottom wall.

9. The liquid containing assembly according to claim 8, wherein the first side wall comprises a first fastening portion, and the second side wall comprises a second fastening portion corresponding to the first fastening portion.

10. The liquid containing assembly according to claim 9, wherein the first fastening portion is a convex portion, and the second fastening portion is an opening.

* * * * *